US009597535B2

(12) United States Patent
Knijnenburg

(10) Patent No.: US 9,597,535 B2
(45) Date of Patent: Mar. 21, 2017

(54) FIRE PROTECTION TROLLEY AND FIRE PROTECTION DEVICE COMPRISING A FIRE PROTECTION TROLLEY OF THIS TYPE

(71) Applicant: Airbus Operations GmbH, Hamburg (DE)

(72) Inventor: Thorsten Knijnenburg, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 0 days.

(21) Appl. No.: 14/711,059

(22) Filed: May 13, 2015

(65) Prior Publication Data

US 2015/0328486 A1 Nov. 19, 2015

(30) Foreign Application Priority Data

May 14, 2014 (DE) ..... 10 2014 209 076

(51) Int. Cl.
*A62C 2/00* (2006.01)
*A62C 3/08* (2006.01)
*A62C 31/28* (2006.01)

(52) U.S. Cl.
CPC ..... *A62C 3/08* (2013.01); *A62C 31/28* (2013.01)

(58) Field of Classification Search
CPC .. H01M 10/658; H01M 2/1094; H01M 2/127; H01M 10/65; A62C 2/00; A62C 2/06; A62C 3/08; A62C 3/07; A62C 3/10; A62C 99/0009; A62C 99/009
USPC ..... 220/560.01, 88.1, 89.1; 169/66, 49
See application file for complete search history.

(56) References Cited

U.S. PATENT DOCUMENTS

| | | | | |
|---|---|---|---|---|
| 4,420,047 | A * | 12/1983 | Bruensicke | A62C 5/02 169/53 |
| 4,436,125 | A * | 3/1984 | Blenkush | F16L 37/0841 137/797 |
| 5,555,156 | A | 9/1996 | Decante | |
| 7,721,752 | B2 * | 5/2010 | Stotkiewitz | B65D 77/225 137/246 |
| 8,544,670 | B2 * | 10/2013 | Brilmyer | G11B 33/1406 109/33 |
| 2013/0146603 | A1 | 6/2013 | Brilmyer | |

FOREIGN PATENT DOCUMENTS

| | | | |
|---|---|---|---|
| CN | 101961537 | A | 2/2011 |
| DE | 2554224 | A1 | 6/1977 |
| DE | 7832686 | U1 | 2/1979 |
| DE | 102010031909 | A1 | 1/2012 |
| DE | 102007054291 | A1 | 7/2013 |
| DE | 102013203482 | A1 | 9/2014 |

OTHER PUBLICATIONS

German Patent Office, German Search Report for German Patent Application No. 10 2014 209 076.8 mailed Nov. 19, 2014.

* cited by examiner

*Primary Examiner* — Arthur O Hall
*Assistant Examiner* — Viet Le
(74) *Attorney, Agent, or Firm* — Lorenz & Kopf, LLP.

(57) ABSTRACT

A fire protection trolley for securing a burning or flammable article, in particular for the interior of an aircraft or spacecraft, includes a sealable, fire-resistant safety container, and an interface connected to the safety container and formed for connection to a counterpart interface of a smoke gas exhaust line for removing a medium located in the safety container. A fire protection device has a fire protection trolley of this type which may be included in an aircraft or spacecraft.

32 Claims, 6 Drawing Sheets

FIRE PROTECTION TROLLEY AND FIRE PROTECTION DEVICE COMPRISING A FIRE PROTECTION TROLLEY OF THIS TYPE

CROSS-REFERENCE TO RELATED APPLICATION

This application claims priority to German Patent Application No. 10 2014 209 076.8 filed May 14, 2014, which is incorporated herein by reference in its entirety.

TECHNICAL FIELD

The embodiments described herein relate to a fire protection trolley for securing a burning article, as well as to a fire protection device comprising a fire protection trolley of this type, and to an aircraft or spacecraft comprising a fire protection device of this type.

Other objects, desirable features and characteristics will become apparent from the subsequent summary and detailed description, and the appended claims, taken in conjunction with the accompanying drawings and the following background.

BACKGROUND

Fire protection for the interior of vehicles, in particular of aircraft or spacecraft, is generally provided by providing extinguishing means, for example manually operable extinguishing devices, such as fire extinguishers or fire blankets. In particular, in large-capacity vehicles, however, it is necessary for an extinguishing device to be as mobile as possible so as to be able to be moved to a fire source or a burning article in such a way that a fire can be combatted locally at the place of origin thereof. Therefore, fire extinguishers or fire blankets are generally attached to a wall so as to be easily accessible and removable from the wall by breaking a retainer or a seal.

German utility model DE 78 32 686 U1 discloses a foam extinguishing hand cart. This comprises a foaming agent container and a mixer, to which a water line can be connected. The extinguishing foam to be emitted to extinguish a fire is produced by mixing the water and the foaming agent in the mixer.

As mobile devices comprising lithium ion batteries become widespread and are increasingly authorised for use, in particular everyday mobile devices such as mobile telephones, tablet PCs, notebook PCs and the like, new fire protection requirements have arisen.

SUMMARY

One object of the present embodiments is to provide an improved approach to fire protection for the interior of vehicles.

In accordance with an embodiment, there is provided a fire protection trolley for securing a burning or flammable article, in particular for the interior of an aircraft or spacecraft, comprising: a sealable, fire-resistant safety container; and an interface connected to the safety container and formed for connection to a counterpart interface of a smoke gas exhaust line for removing a medium located in the safety container.

In accordance with a further embodiment, there is provided a fire protection device for securing a burning or flammable article, in particular for an aircraft or spacecraft, comprising: a fire protection trolley according to the embodiment; a smoke gas exhaust line having a counterpart interface that can be coupled to the interface of the fire protection trolley; and an outlet device connected to the smoke gas exhaust line and provided and arranged for emitting the medium into an environment of the fire protection device.

There is also provided an aircraft or spacecraft comprising a fire protection device according to an embodiment.

The idea behind the present embodiments is that it is advantageous to let a burning article, in particular a burning lithium ion battery, burn out in a fire-proof environment insulated from the interior of a vehicle.

A burning or flammable article also includes an article liable to burn. It further includes an article that contains a dangerous or harmful medium and emits a gas or is liable to emit a gas for reasons other than fire. It also includes an article containing an expanding or explosive medium that is volatile (for example petrol) or compressed (for example propane gas) or otherwise escapes or is liable to escape (for example, because of a leak).

A medium located in the safety container includes for example smoke gas, but also a mixture of an extinguishing means or extinguishing gas and smoke gas, as well as any other hazardous or harmful medium that can escape from the articles. Naturally, any mixtures of different media, of media with air and/or extinguishing gas or other extinguishing means are also included.

The idea behind the present embodiment now involves providing a mobile fire protection trolley that has a sealable, fire-resistant, safety container in that the burning article can be secured and guided to a smoke gas exhaust line in a controlled manner, in such a way that smoke gases no longer escape into the interior once the burning article is located in the safety container.

Further, articles that are potentially liable to burn may also be stored in the safety container to prevent a fire. Further, the fire protection trolley advantageously also replaces all ashtrays that are sometimes provided for securing cigarettes or the like that are impermissibly smoked on board.

The safety container preferably meets at least fire protection class F90, in other words is fire-resistant for at least 90 minutes. It can be connected to a smoke gas exhaust line via an interface, in such a way that smoke gas or combustion gas or smoke that expands because of the fire can be removed from the vehicle in a safe manner. The interface may for example be formed as a tubular transition piece between the wall of the safety container and a subsequent pipeline. Formation as a male or female transition piece is equally conceivable. The interface is connected to the safety container in particular in such a way that when the interface is connected to the counterpart interface a fluid connection from the safety container to the smoke gas exhaust line is established. Apart from this, the safety container remains sealed. Preferably, the fluid connection from the safety container to the smoke gas exhaust line is hermetically sealed.

The environment of the fire protection device, into which the smoke gas is released, may be an external environment of a vehicle, in particular of an aircraft or spacecraft. Alternatively, it may equally be a capture container, a suction removal system, a reprocessing system, a filter or the like. All that is of decisive importance is that the smoke gas does not come back into an interior in that the fire protection trolley is located.

According to one embodiment, the interface comprises a releasable coupling device. Alternatively or in addition, the releasable coupling device may also be provided on the counterpart interface. Further, parts of the coupling device may be provided both on the interface and on the counterpart interface. The coupling device is formed and arranged for releasably connecting the interface to the counterpart interface. The releasable connection is preferably hermetically sealed in the closed state. In particular "quick-disconnect" connections, marketed for example by Hydraflow or by Diehl Avionics Systeme GmbH, are possible as a coupling device. Advantageously, the connection of the interface to the counterpart interface can thus be opened and closed. If the connection is opened, the fire protection trolley is mobile without restriction for securing a burning or flammable article. In the connected state, safe removal of a medium located in the safety container, in particular of smoke gas from a burning article, can be ensured.

According to a further embodiment, the coupling device comprises a sealing device, which seals automatically in a disconnected state. In a disconnected state, in other words in a state where it is separated from the counterpart interface, the interface thus stays sealed automatically. Preferably, the interface stays hermetically sealed automatically in the disconnected state. By contrast, in a connected state, in which the interface is connected to the counterpart interface, a fluid connection is established between the safety container and the smoke gas exhaust line. Particularly advantageously, in this way the fire protection trolley can be used as a mobile unit in a disconnected state, in other words be moved independently of the smoke gas exhaust line, without smoke gas escaping from the safety container.

According to a still further embodiment, an actuation device for releasing the coupling device is provided. Alternatively or in addition, the actuation device may also be provided for closing the coupling device. The actuation device may either be provided directly on the interface or be arranged on another region of the fire protection trolley that is easily accessible to a person pushing or operating the fire protection trolley. Preferably, a position of this type is easily accessible even when the fire protection trolley is located in a parking slot provided therefor. This is thus a position that is preferably on or close to a front face, for example close to a pushing or holding handle, of the fire protection trolley. Advantageously, the interface and the counterpart interface may thus be configured for anchoring the fire protection trolley. In this way, there is an integration of components, since the interface and the counter interface are simultaneously used for connecting the safety container and for mechanically anchoring the fire protection trolley.

According to another embodiment, the safety container is provided connected to an extinguishing system. For this purpose, the extinguishing system is for example integrated into the fire protection trolley in the form of an extinguishing means container in a fluid connection with the safety container. The extinguishing means container may for example be a replaceable $CO_2$ cartridge. Alternatively or in addition, the safety container is formed so as to be connectable to an extinguishing system. For this purpose, a further interface, via which a fluid connection to an external extinguishing system can be established, may for example be provided on the safety container. Preferably, this further interface is likewise equipped with a sealing means, which stays tight in a disconnected state, in particular stays hermetically sealed. An extinguishing system is preferably an extinguishing gas system that is formed to flood the safety container with an extinguishing gas (as an extinguishing means). This is in particular a $CO_2$ extinguishing system or a halon extinguishing system that is formed to flood the safety container with $CO_2$ or halon so as to smother a fire.

According to a further embodiment, the safety container comprises an overpressure valve. This is in particular configured to open at a maximum pressure at that the safety container barely still remains hermetically sealed in the closed state. In particular, this is a maximum pressure at that the cover of the safety container barely still remains tight. The overpressure valve may be integrated with the interface in such a way that medium that escapes from the overpressure valve in the event of a maximum pressure leaves the safety container through the interface. Alternatively, the overpressure valve may also be arranged on a region of the safety container remote from the interface. It would further be conceivable for a capture sack or the like, which can provisionally receive smaller amounts of medium flowing out of the overpressure valve until the safety container is connected to a smoke gas exhaust line, to be provided on the overpressure valve. Alternatively or in addition, the safety container is formed hermetically sealed. In particular, the safety container is provided so as to be inherently tight and hermetically tightly sealable using a cover. Further, the safety container is alternatively or additionally made explosion-proof. In particular, the safety container may be formed with a constructional explosion protection, for example in accordance with the ATEX standard. Overall, a very safe safety container is thus provided, which receives smoke gas produced by a burning medium at least up to a maximum pressure. There is thus advantageously an extended time window available in that the fire protection trolley comprising a closed safety container can be moved to a connection point of a smoke gas exhaust line for connection to the smoke gas exhaust line without a medium located in the safety container, in particular smoke gas produced by a burning article, being able to escape. Thus, the interior, in particular of an aircraft or spacecraft, is protected from the smoke gas.

According to a still further embodiment, the fire protection trolley is equipped with a fire-proof gripping tool. Alternatively or in addition, protective gloves may also be included in the accessories of the fire protection trolley. Using the gripping tool, and alternatively or in addition using the protective gloves, a burning or flammable article can be gripped and displaced or introduced into the safety container. In this way, the burning or flammable article is secured in the safety container. Further, alternatively or in addition, the fire protection trolley is equipped with a fire extinguisher, a fire blanket and/or a sand container. These are used for example for extinguishing a burning region surrounding the burning or flammable article or also if appropriate for extinguishing and/or cooling a burning article or for securing a burning article. If the burning or flammable article, as the fire source, is secured in the safety container, a fire that has spread to the region surrounding the article can be extinguished rapidly or an escaped medium can be secured. The region surrounding the article means the surrounding region in that the article was located before being secured. This can be undertaken directly using the fire extinguisher, the fire blanket and/or the sand container, in such a way that advantageously no further step or further person is required for fetching it.

According to a yet further embodiment, the safety container comprises an openable cover for introducing a fire article. This may be a removable or hinged cover. For example, the cover may be made hermetically sealable. Advantageously, the safety container can thus be sealed safely, in particular hermetically, in a simple manner, in such a way that smoke gas is prevented from escaping from the safety container.

According to yet another embodiment of a fire protection device, the outlet device comprises an overpressure seal, which opens automatically when an opening pressure in the smoke gas exhaust line is reached. If the fire protection device is provided in an aircraft or spacecraft, the outlet device may for example be provided on the outer skin of the aircraft or spacecraft. For example, in this case it is configured to be heated, in such a way that icing is countered or can be countered if required. Outlet devices of this type on an outer skin are also referred to as an "outer port". The outlet device is only normally closed and opened by the overpressure seal in the event of a rise in pressure in the smoke gas exhaust line. In particular, once it has been used, the outlet device subsequently has to be sealed again by putting on the overpressure seal. The opening pressure required for opening the overpressure seal is lower than the pressure required for opening the overpressure valve of the safety container. For example, the opening pressure of the overpressure seal is a comparatively low pressure, for example in the range of 0.5 to 5 mbar (overpressure), in particular in a range between 1 mbar and 2 mbar, particularly preferably between 1 mbar and 1.5 mbar. At an opening pressure of this type, for example greater than 1.3 mbar, the outlet device is for example set to a throughput or flow rate of 3300 l/min or 55 l/s. However, this setting may also vary considerably. The resulting rise in pressure over time depends on the volume of the safety container and the amount of the substance burning therein or volume of the burning article. In a safety container set to higher pressures, a higher opening pressure may thus be selected, and a higher throughput can be achieved even at the same outlet cross section. Alternatively, a larger outlet cross section may be selected so as to increase the throughput and/or compensate the safety container being set to lower pressures. The outlet cross section may for example be in ranges of 0.5 $cm^2$ to 100 $cm^2$, in particular 1 $cm^2$ to 10 $cm^2$, preferably 2.5 $cm^2$ to 7.5 $cm^2$. A throughput cross section of 5 $cm^2$ corresponds for example to an outlet pipe of approximately 2.5 cm diameter.

According to a further embodiment of an aircraft or spacecraft, the outlet device is arranged on an outer skin of the aircraft or spacecraft. Alternatively or additionally, however, it would also be conceivable to provide the outlet device in a capture container, on a suction system or the like. An advantage of providing the outlet device on the outer skin is that no extra capture container and no suction system have to be provided, and they therefore also do not have to be transported along, leading to a reduction in weight.

According to a yet further embodiment, a parking slot for the fire protection trolley is provided in an interior of the aircraft or spacecraft. In this case, the counterpart interface is arranged in the parking slot. The position of the counterpart interface corresponds to the position of the interface on the fire protection trolley. Alternatively or in addition, the coupling device is provided and configured to be couplable to the counterpart interface by inserting the fire protection trolley into the parking slot. In this way, particularly advantageously, the interface of the fire protection trolley can be connected to the counterpart interface in a very simple manner simply by pushing the fire protection trolley into the parking slot.

According to a still further embodiment, a trigger device for triggering the extinguishing system is provided in the parking slot. For example, the trigger device is formed in such a way that when a state of the safety container coupled to the smoke gas exhaust line is achieved the extinguishing system is automatically triggered or a switch for manual triggering is activated. The extinguishing system may be provided connected to the safety container. In particular, it is integrated into the fire protection trolley so as to be constantly connected to the safety container. Alternatively or in addition, the extinguishing system may also be arranged in the interior of the aircraft or spacecraft. In this case, the safety container comprises a further interface and the parking slot comprises a further corresponding counterpart interface for connection to the extinguishing system. When the fire protection trolley is inserted, a connection of the safety container to the smoke gas exhaust line and to the extinguishing system can thus be established simultaneously. Triggering the extinguishing system in a state where the safety container is already connected to the smoke gas exhaust line or is simultaneously being connected thereto is advantageous because introducing an extinguishing gas or extinguishing means causes the pressure in the safety container to rise. If the safety container is connected to the smoke gas exhaust line, an overpressure produced in this manner can immediately be relieved. However, if the safety container is made appropriately strong, flooding with extinguishing gas or extinguishing means is conceivable even in a state disconnected from the smoke gas exhaust line.

According to a further embodiment, the interface and the counterpart interface are configured for anchoring the fire protection trolley in the parking slot. In this way, there is a component integration, since the interface and the counterpart interface are used simultaneously for connecting the safety container and for mechanically anchoring the fire protection trolley in the parking slot. In this way, the number of parts, and thus the weight and costs of the aircraft or spacecraft, are advantageously reduced.

The above embodiments and developments can be combined in any desired manner, within reason. Further possible embodiments, developments and implementations of the embodiment also include combinations not explicitly mentioned of features of the embodiment that are described above or in the following in relation to the embodiments. In particular, the person skilled in the art will also add individual aspects to the respective basic form of the present embodiment as improvements or supplements.

BRIEF DESCRIPTION OF THE DRAWINGS

The various embodiments will hereinafter be described in conjunction with the following drawing figures, wherein like numerals denote like elements, and wherein.

Figure 1:
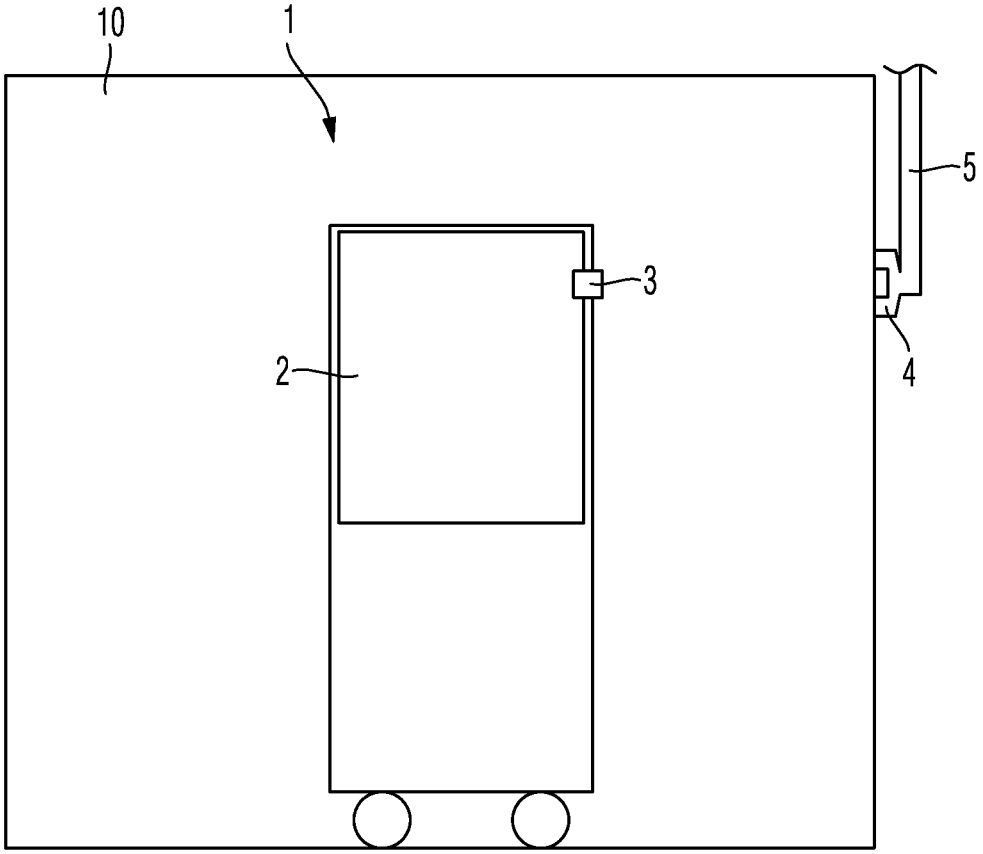
FIG. 1 is a schematic drawing of a fire protection trolley in accordance with an embodiment.

The accompanying drawings are intended to provide further understanding of the embodiments of the embodiment. They illustrate embodiments and are used in connection with the description to clarify principles and ideas of the embodiment. Other embodiments and many of the stated advantages can be seen from the drawings. The elements of the drawings are not necessarily shown to scale with one another.

In the drawings, like, functionally equivalent and equivalently acting elements, features and components are provided with like reference numerals in each case unless stated otherwise.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description FIG. 1 is a schematic drawing of a fire protection trolley 1 in accordance with a first embodiment. The fire protection trolley 1 is arranged in an interior 10. The interior 10 may, for example, be the interior of an aircraft or spacecraft. The fire protection trolley 1 comprises a closable, fire-resistant safety container 2. The fire protection trolley 1 further comprises an interface 3 connected to the safety container 2. On one edge of the interior 10, a smoke gas exhaust line 5 is provided. This comprises a counterpart interface 4, which is couplable to the interface 3 of the safety container 2 of the fire protection trolley 1 in such a way that a connection of the interface 3 to the counterpart interface 4 of the smoke gas exhaust line 5 for removing a medium located in the safety container 2 can be established. Purely by way of example, in this case the counterpart interface 4 is shown on the edge of the interior. However, it may be provided at any desired location, in the interior 10 or on the edge of the interior 10, which can be reached by the interface 3.

Preferably, the interface 3 and the counterpart interface 4 are positioned at the same height for easier connection. The smoke gas exhaust line 5 leads out of the interior 10. It may for example lead into an open environment, in particular outside the outer skin of an aircraft or spacecraft. Alternatively or in addition, the smoke gas exhaust line 5 may also lead to a capture container, a suction system, a filtering or reprocessing system or the like.

Figure 2:
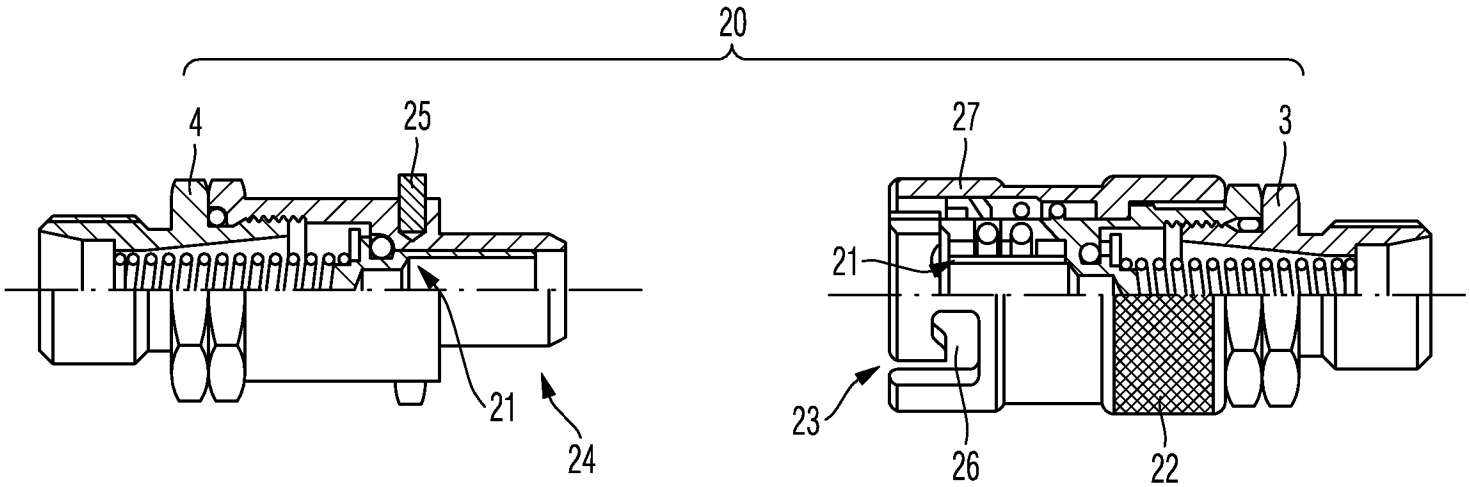
FIG. 2 is a half-section drawing of a connection of an interface to a counterpart interface in an open state.

FIG. 2 is a half-section drawing of a connection of an interface 3 to a counterpart interface 4 in an open state. The interface 3 and the counterpart interface 4 each comprise parts of a coupling device 20, by means of that a releasable connection of the interface 3 to the counterpart interface 4 is possible. In the embodiment shown, the interface 3 is provided with a female part 23 of a coupling device, whilst the counterpart interface 4 is provided with a male part 24 of a coupling device. Naturally, however, a reversed arrangement of the female and male part 23 and 24 would also be conceivable. For connecting the interface 3 to the counterpart interface 4, the male part 24 of the coupling device 20 is inserted into the female part 23 of the coupling device 20. The male part 24 comprises locking pins 25, whilst the female part 23 comprises corresponding fixing grooves 26. When the male part 23 is introduced into the female part 24, a locking pin 25 is guided into a corresponding fixing groove 26. When a final connection position is reached or a connected state is achieved, the fixing groove 26 latches onto the locking pin 25, in such a way that a secure connection of the interface 3 to the counterpart interface 4 is provided. An actuation device 23 in the form of a corrugated ring for releasing the coupling device 20 is provided on the female part 23 of the coupling device 20. The corrugated ring 22 is formed integrally with a movable portion 27, comprising the fixing grooves 26, of the female part 23, and is provided so as to be displaceable relative to the male part 24 counter to a safety spring. To release the connection, by means of the corrugated ring, the displaceable portion 27 can initially be displaced somewhat towards the male part 23, and subsequently be twisted about the axis of symmetry of the corrugated ring to release the locking pins 25. In this position of the movable portion 27, the male part 24 can be pulled out of the female part 23 again. Both the male and the female part 23; 24 have a sealing device 21, which automatically seals the respective part 23; 24 of the coupling device 20 in a disconnected state in that the male part 24 is separated from the female part 24.

Figure 3:
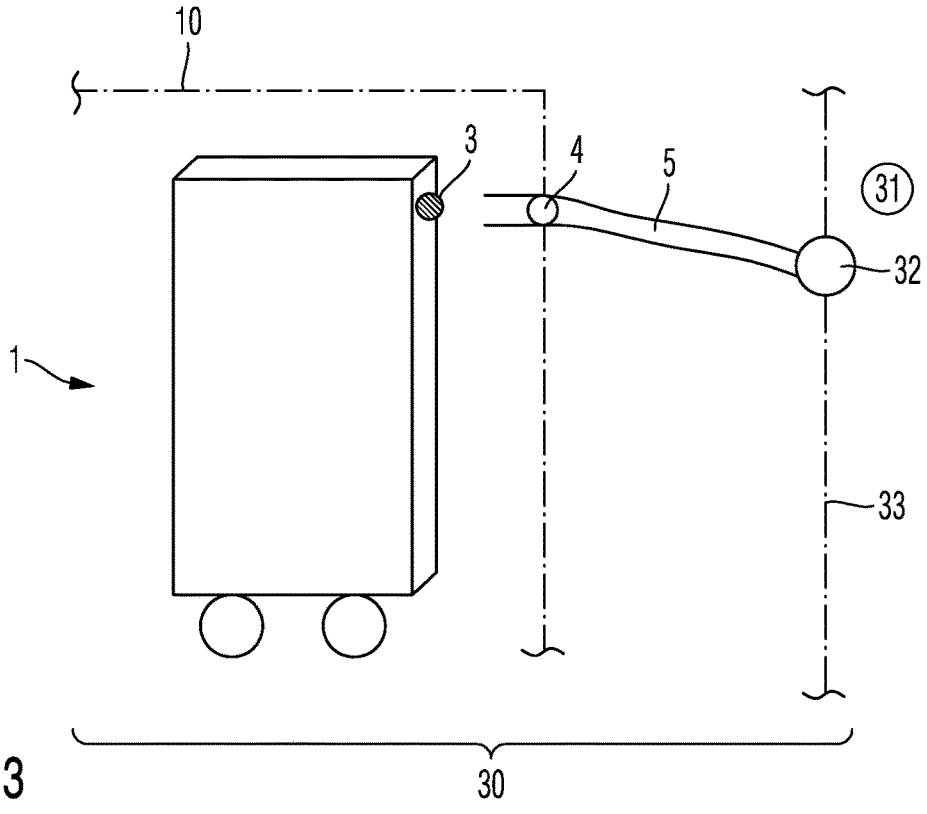
FIG. 3 is a schematic drawing of a fire protection device.

FIG. 3 is a schematic drawing of a fire protection device 30. The fire protection device 30 comprises a fire protection trolley 1. Further, a smoke gas exhaust line 5 is provided that comprises a counterpart interface 4 couplable to the interface 3 of the fire protection trolley 1. At a second end of the smoke gas exhaust line 5, which is arranged at a boundary 33 with an environment 31 of the fire protection device 30, an outlet device 32 is provided. The outlet device is provided and accordingly arranged to emit a medium into the environment. If the fire protection device 30 is arranged in an aircraft or spacecraft, the environment 31 may be an open environment or open space outside the skin of the aircraft or spacecraft. In this case, the boundary 33 would be the outer skin of the aircraft or spacecraft. However, the environment 31 may also further be a capture container, a suction system, a filtering or reprocessing system or the like. In this case, the boundary 33 is a boundary of a container of this type or a system of this type. The boundary 33 separates the environment 31 from the interior 10. The environment 31 is thus outside the interior 10 in that the fire protection trolley 1 is located.

Figure 4:
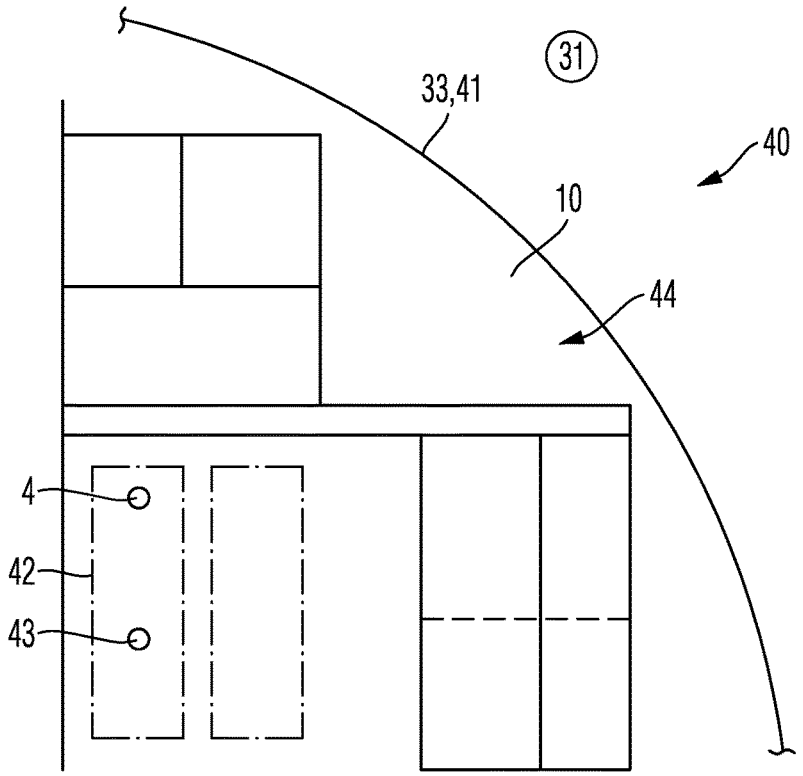
FIG. 4 is a schematic drawing of part of a fuselage cross section of an aeroplane in the region of an on-board kitchen.

FIG. 4 is a schematic drawing of part of a fuselage cross section of an aeroplane 40 in the region of an on-board kitchen 44. The aeroplane 40 comprises an outer skin 41, which forms a boundary 33 with an environment 31. An interior 10, in which the on-board kitchen 44 is located, is arranged inside the outer skin 41. A parking slot 42, which is intended for a fire protection trolley 1, is provided in the on-board kitchen 44. A counterpart interface 4 of a fire protection device is arranged in the parking slot 42. For improved clarity, the associated smoke gas exhaust line 5 and an outlet device 32 arranged on the outer skin 41, which are provided according to the design shown in FIG. 3, are not shown. The parking slot 42 is dimensioned and arranged in such a way that a fire protection trolley 1 can be inserted into it. The counterpart interface 4 is further arranged therein in a position corresponding to the position of the interface 3 on the fire protection trolley 1. The parts 23, 24 of the coupling device 20 according to FIG. 2 which are provided on the interface 3 and the counterpart interface 4 are provided and configured in such a way that the parts 23, 24 of the coupling device 20 can be connected and coupled together by inserting the fire protection trolley 1 into the parking slot 42. A trigger device 43, the operation of which is discussed in greater detail with reference to FIGS. 7 and 8, is further provided in the parking slot 42.

Figure 5:
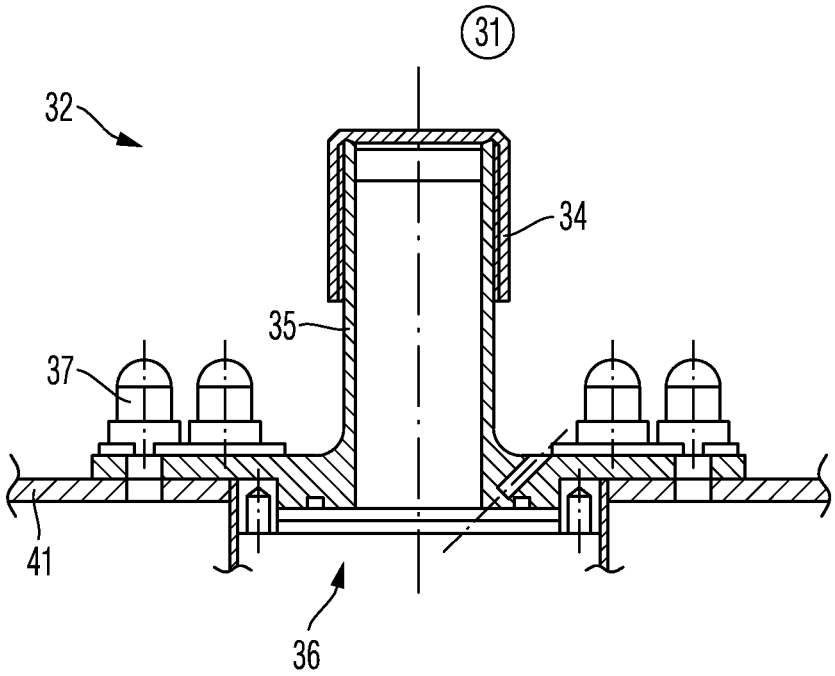
FIG. 5 is a cross-sectional view of an outlet device.

FIG. 5 is a cross-sectional view of an outlet device 32. On the face of the outlet device 32 facing an environment 31, the outlet device 32 comprises an overpressure seal 34. The overpressure seal 34 is placed on a connector 35, which opens into the environment 31. In a flange region 36 of the outlet device 32, remote from the environment, a smoke gas exhaust line 5 (not shown for better clarity) is connected. When there is an overpressure above an opening pressure of for example 1.3 mbar in the smoke gas exhaust line 5, and thus also at the flange region 36 of the outlet device 32, the overpressure seal 34 is slid down towards the environment 31 from the flange, in such a way that the flange 35 is opened to the environment 31. For example, the outlet device 32 may be arranged on an outer skin 41 of an aircraft or spacecraft, which skin is shown here by way of example. For this purpose, the outlet device 32 is fixed in the outer skin 41 by means of rivets 37. The outlet device 32 comprises a heating device (not shown) so as to keep the outlet device free of ice or to free it from ice when required.

Figure 6:
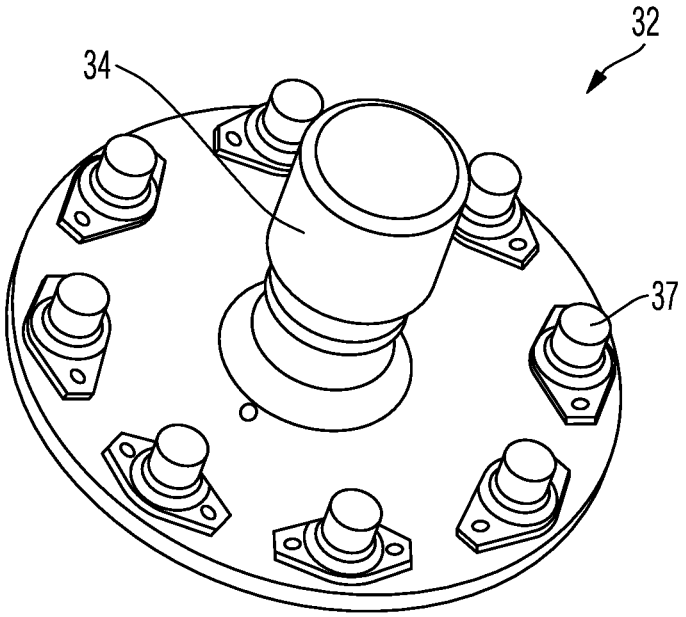
FIG. 6 is a perspective view of an outlet device according to FIG. 5.

FIG. 6 is a perspective drawing of the outlet device 32. By way of example, the outlet device 32 is fixed to the outer skin (not shown in FIG. 6) using a total of eight rivets 37. Naturally, another expedient number of rivets 7 is also possible, depending on the configuration and size of the outlet device.

Figure 7:
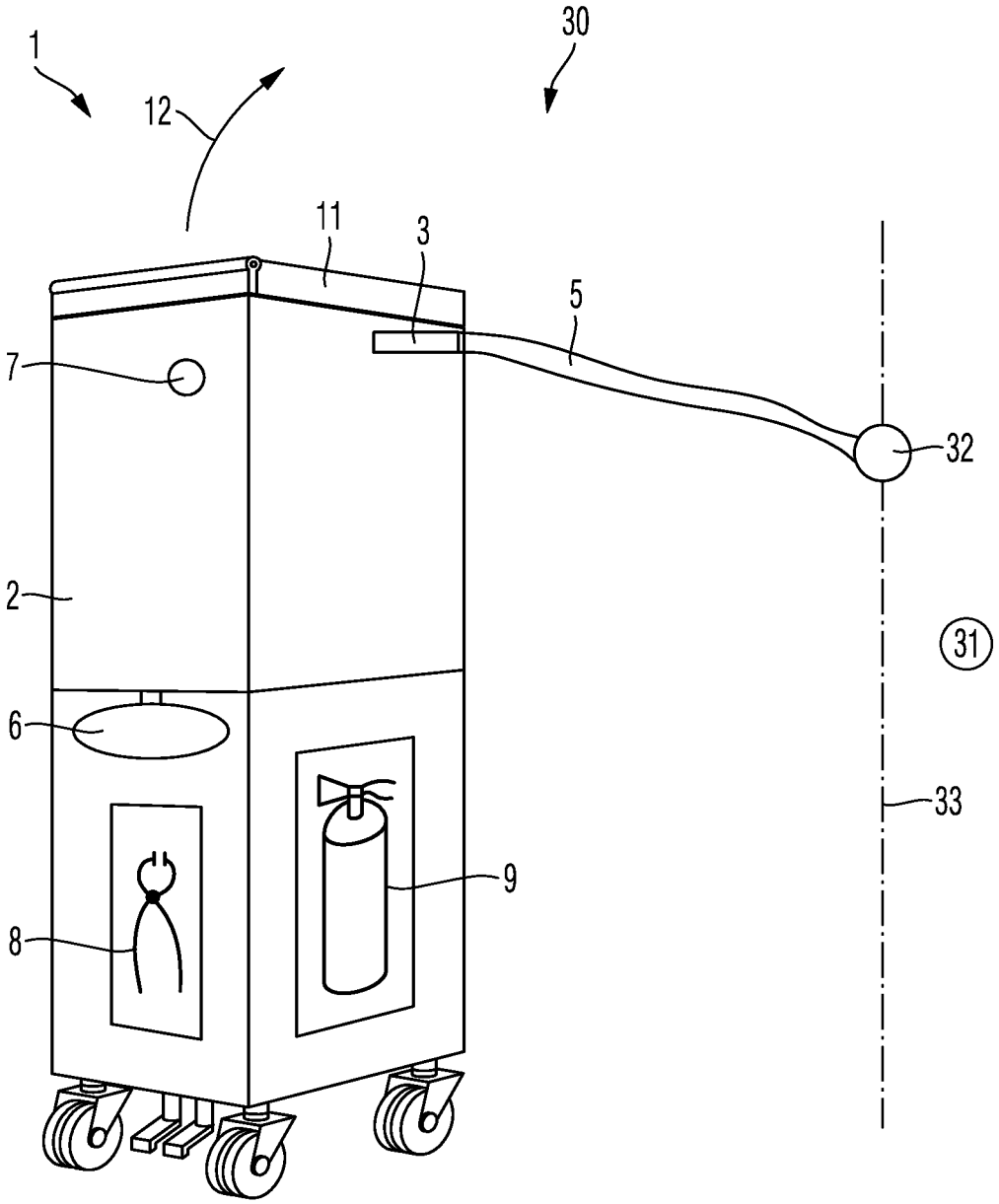
FIG. 7 is a fire protection device comprising a fire protection trolley in accordance with a further embodiment.
Figure 8:
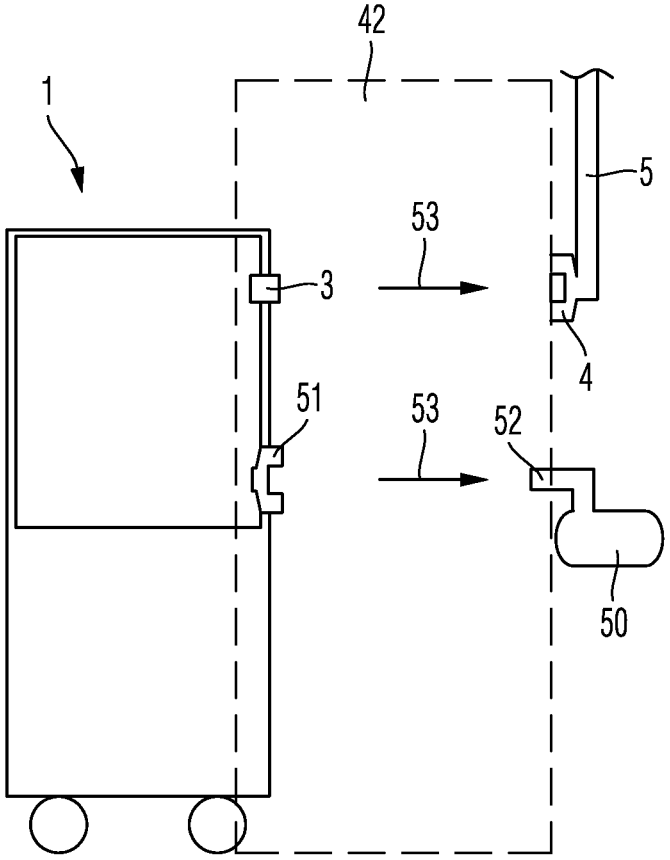
FIG. 8 is a schematic cross-sectional view of a parking slot and of a fire protection trolley in accordance with another embodiment.

FIG. 7 shows a fire protection device 30 comprising a fire protection trolley 1 in accordance with a further embodiment. The fire protection trolley 1 may be provided in a fire protection device 30 according to FIG. 3, in an aeroplane according to FIG. 4, and also in a general interior according to FIG. 1.

The fire protection trolley 1 comprises a protective container 2, which, together with an interface 3 for connection to a counterpart interface 4 (not shown), is formed for removing a medium located in the safety container 2.

The safety container 2 comprises a hinged cover 11, which is made hermetically sealable. For this purpose, for example, a fire-resistant seal (not shown in greater detail) and a closure (not shown in greater detail) are provided.

An overpressure valve 7 is further provided on the safety container 2, and is configured in such a way that it triggers at a maximum pressure, at which the hermetically sealed cover barely still stays tight, and likewise keeps the safety container hermetically sealed at a lower pressure.

A $CO_2$ extinguishing system 6 is connected to the safety container 2, and is provided integrated into the fire protection trolley. Alternatively, this may also be a halon extinguishing system. In the event of a burning article located in the safety container 2, the extinguishing system 6 may be activated to extinguish the burning article, in such a way that the safety container is flooded with extinguishing gas. The safety container 2 is preferably flooded until there is no longer any oxygen therein. Preferably, the extinguishing gas is a gas, for example $CO_2$, having a higher density than air, in such a way that during the flooding the lighter air escapes at an interface 3, preferably positioned at the top of the safety container 2. In this way, residual oxygen present in the safety container can be urged through the interface into the smoke gas exhaust line by means of the extinguishing gas. Advantageously, there is subsequently no longer any oxygen available for combustion.

Furthermore, further safety apparatus is provided in the fire protection trolley 1, including a fire-proof gripping tool 8 in the form of insulated tongs and a fire extinguisher 9, preferably a $CO_2$ fire extinguisher. Further, protective gloves (not shown) may also be provided for protected use of the griping tool. Further, a fire blanket or a sand container for smothering a fire or for securing a surrounding region may also be provided.

For securing a burning article, the cover 11 is opened in the illustrated opening direction 12 by flipping open. The burning article is subsequently, in particular with the assistance of the gripping tool 8, displaced into the safety container 2. Subsequently, the cover 11 is closed again and hermetically tightly sealed, in such a way that the burning article is secured in the safety container.

If the burning article has set a surrounding region alight or on fire, this surrounding region may finally be extinguished, in particular by means of the fire extinguisher 9. Further, the environment may also be extinguished or secured using a fire blanket (not shown) and/or using sand from a sand container (not shown). In this way, the fire is fully combatted and is completely extinguished in a region outside the safety container 2.

The fire protection trolley is subsequently slid to and connected to the smoke gas exhaust line 5. Subsequently, by means of the extinguishing system 6, which can be activated using a switch (not shown), the safety container 2 is flooded with an extinguishing gas, in particular $CO_2$ or halon. On the one hand, oxygen still located in the safety container is blown out into the smoke gas exhaust line 5, and on the other hand, the fire is simultaneously smothered using the extinguishing gas.

FIG. 8 is a schematic cross-sectional view of a parking slot 42 and a fire protection trolley 1 in accordance with a further embodiment. The parking slot 42 may be a parking slot 42 in an on-board kitchen 44 according to FIG. 4. However, it is not limited thereto, but may be provided in any conceivable interiors 10 for fields of use of the fire protection trolley 1.

In this embodiment, the fire protection trolley 1 comprises a further interface 51, in addition to the interface 3, on the safety container 2 thereof. A further counterpart interface 52, which is connected to an extinguishing system 50 provided in the parking slot 42, is provided in the parking slot 42 in addition to the counterpart interface 4 connected to the smoke gas exhaust line 5. The two interfaces 3, 51 and the two counterpart interfaces 4, 52 are arranged in a mutually corresponding manner at the same height and position, in such a way that when the fire protection trolley 1 is inserted into the parking slot 42 in a predetermined insertion direction 53, indicated by arrows, a connection can be established between the interfaces 3 and 51 and the respectively corresponding counterpart interfaces 4 and 52. Further, the interfaces 3 and/or 51 and counterpart interfaces 4 and/or 52 are preferably configured in such a way that the fire protection trolley 1 is anchored in the parking slot when connected.

Although the present embodiment has been described above by way of preferred embodiments, it is not limited thereto, but can be modified in various ways. In particular, the disclosed embodiments and individual features thereof can be combined with one another.

What is claimed is:

1. An aircraft comprising a fire protection device for securing a burning or flammable article, the fire protection device comprising:

a fire protection trolley comprising a sealable fire-resistant safety container;

an interface connected to the safety container and configured to be connected to a counterpart interface of a smoke gas exhaust line for removing a medium located in the safety container;

a smoke gas exhaust line having a counterpart interface which can be coupled to the interface of the fire protection trolley; and an outlet device connected to the smoke gas exhaust line and provided and arranged for emitting the medium into an environment of the fire protection device, wherein the outlet device is arranged on an outer skin of the aircraft.

2. The aircraft according to claim 1, wherein a parking slot for the fire protection trolley is provided in an interior of the aircraft, the counterpart interface being arranged in the parking slot in a position that corresponds to the position of the interface on the fire protection trolley, and/or the coupling device being provided and configured to be couplable to the counterpart interface by inserting the fire protection trolley into the parking slot.

3. The aircraft according to claim 2, wherein a trigger device for triggering an extinguishing system is provided in the parking slot for automatically triggering when a state coupled to the smoke gas exhaust line is achieved or for activating a switch for manual triggering, the extinguishing system being connected to the safety container and/or the extinguishing system being arranged in the interior of the aircraft, the safety container comprising a further interface and the parking slot comprising a further corresponding counterpart interface for connection to the extinguishing system.

4. The aircraft according to claim 2, wherein the interface and the counterpart interface are configured for anchoring the fire protection trolley in the parking slot.

5. The aircraft according to claim 1 wherein the aircraft is a spacecraft.

6. The aircraft according to claim 1, wherein the interface and/or the counterpart interface comprise a releasable coupling device formed and arranged for releasably connecting the interface to the counterpart interface.

7. The aircraft according to claim 6, wherein the coupling device comprises a sealing device that seals automatically in a disconnected state.

8. The aircraft according to claim 6, wherein an actuation device is provided for releasing and/or closing the coupling device.

9. The aircraft according to claim 1, wherein the safety container is coupled to an extinguishing system.

10. The aircraft according to claim 9, wherein the extinguishing system is a $CO_2$ or a halon extinguishing system.

11. The aircraft according to claim 1, wherein the safety container comprises an overpressure valve.

12. The aircraft according to claim 1, wherein the fire protection trolley is equipped with a fire-proof griping tool.

13. The aircraft according to claim 12, wherein the fire-proof gripping tool comprises gloves for gripping a burning or flammable article or at least one of a first extinguisher, a fire blanket, and a sand container.

14. The aircraft according to claim 1, wherein the safety container comprises an openable cover for introducing a burning article.

15. The aircraft according to claim 14, wherein the openable cover comprises a removable or hinged cover, and wherein the cover is made hermetically sealable.

16. The aircraft according to claim 1, wherein the outlet device comprises an overpressure seal that opens automatically when an opening pressure in the smoke gas exhaust line is reached.

17. The aircraft according to claim 1, wherein the safety container is hermetically tight or explosion-proof.

18. An aircraft comprising a fire protection device for securing a burning or flammable article, the fire protection device comprising:

a fire protection trolley comprising a sealable fire-resistant safety container;

an interface connected to the safety container and configured to be connected to a counterpart interface of a smoke gas exhaust line for removing a medium located in the safety container;

a smoke gas exhaust line having a counterpart interface which can be coupled to the interface of the fire protection trolley; and an outlet device connected to the smoke gas exhaust line and provided and arranged for emitting the medium into an environment of the fire protection device;

wherein a parking slot for the fire protection trolley is provided in an interior of the aircraft, the counterpart interface being arranged in the parking slot in a position that corresponds to the position of the interface on the fire protection trolley, and/or the coupling device being provided and configured to be couplable to the counterpart interface by inserting the fire protection trolley into the parking slot; and wherein a trigger device for triggering an extinguishing system is provided in the parking slot for automatically triggering when a state coupled to the smoke gas exhaust line is achieved or for activating a switch for manual triggering, the extinguishing system being connected to the safety container and/or the extinguishing system being arranged in the interior of the aircraft, the safety container comprising a further interface and the parking slot comprising a further corresponding counterpart interface for connection to the extinguishing system.

19. The aircraft according to claim 18, wherein the interface and the counterpart interface are configured for anchoring the fire protection trolley in the parking slot.

20. The aircraft according to claim 18 wherein the aircraft is a spacecraft.

21. The aircraft according to claim 18, wherein the interface and/or the counterpart interface comprise a releasable coupling device formed and arranged for releasably connecting the interface to the counterpart interface.

22. The aircraft according to claim 21 wherein the coupling device comprises a sealing device that seals automatically in a disconnected state.

23. The aircraft according to claim 21, wherein an actuation device is provided for releasing and/or closing the coupling device.

24. The aircraft according to claim 18, wherein the safety container is coupled to an extinguishing system.

25. The aircraft according to claim 24, wherein the extinguishing system is a $CO_2$ or a halon extinguishing system.

26. The aircraft according to claim 18, wherein the safety container comprises an overpressure valve.

27. The aircraft according to claim 18, wherein the fire protection trolley is equipped with a fire-proof griping tool.

28. The aircraft according to claim 27, wherein the fire proof gripping tool comprises gloves for gripping a burning or flammable article or at least one of a first extinguisher, a fire blanket, and a sand container.

29. The aircraft according to claim 18, wherein the safety container comprises an openable cover for introducing a burning article.

30. The aircraft according to claim 29, wherein the openable cover comprises a removable or hinged cover, and wherein the cover is made hermetically sealable.

31. The aircraft according to claim 18, wherein the outlet device comprises an overpressure seal that opens automatically when an opening pressure in the smoke gas exhaust line is reached.

32. The aircraft according to claim 18 wherein the safety container is hermetically tight or explosion-proof.

* * * * *